US012584245B2

(12) United States Patent
Meinders et al.

(10) Patent No.: US 12,584,245 B2
(45) **Date of Patent: *Mar. 24, 2026**

(54) TRILOBAL FILAMENTS AND SPINNERETS FOR PRODUCING THE SAME

(71) Applicant: ALADDIN MANUFACTURING CORPORATION, Calhoun, GA (US)

(72) Inventors: Maarten Meinders, Dalton, GA (US); Paul Pustolski, Newark, DE (US)

(73) Assignee: ALADDIN MANUFACTURING CORPORATION, Calhoun, GA (US)

( * ) Notice: Subject to any disclaimer, the term of this patent is extended or adjusted under 35 U.S.C. 154(b) by 408 days.

This patent is subject to a terminal disclaimer.

(21) Appl. No.: 18/179,535

(22) Filed: Mar. 7, 2023

(65) Prior Publication Data

US 2023/0203716 A1 Jun. 29, 2023

Related U.S. Application Data

(60) Continuation of application No. 16/430,411, filed on Jun. 3, 2019, now Pat. No. 11,608,571, which is a division of application No. 15/488,825, filed on Apr. 17, 2017, now Pat. No. 11,692,284.

(60) Provisional application No. 62/376,698, filed on Aug. 18, 2016.

(51) Int. Cl.

| | |
|---|---|
| ***D01D 5/253*** | (2006.01) |
| ***D01D 5/24*** | (2006.01) |
| ***D01F 6/60*** | (2006.01) |

(52) U.S. Cl.

CPC ..... *D01D 5/253* (2013.01); *D01D 5/24* (2013.01); *D01F 6/60* (2013.01)

(58) Field of Classification Search

CPC ..... D01D 5/253; D01D 5/24

See application file for complete search history.

(56) References Cited

U.S. PATENT DOCUMENTS

| | | | |
|---|---|---|---|
| 3,419,936 | A | 1/1969 | Sims |
| 3,493,459 | A | 2/1970 | Mcintosh et al. |
| 3,558,420 | A | 1/1971 | Opfell et al. |

(Continued)

FOREIGN PATENT DOCUMENTS

| | | | | |
|---|---|---|---|---|
| EP | 0601372 | | 6/1994 | |
| EP | 0625219 | | 2/1998 | |
| KR | 20100001615 | A * | 1/2010 | ..... D01D 5/253 |

OTHER PUBLICATIONS

Advisory Action issued in co-pending U.S. Appl. No. 15/488,825, mailed Nov. 29, 2019.

(Continued)

*Primary Examiner* — Jerzi H Moreno Hernandez

(74) *Attorney, Agent, or Firm* — Meunier Carlin & Curfman LLC

(57) ABSTRACT

Various implementations include a spinneret plate defining a plurality of capillaries, including a first, second, and third capillary portions with a substantially hexagonal central area therebetween. The substantially hexagonal central area is joined to the spinneret plate by first and second legs being radially spaced apart and separate by a first apex of the substantially hexagonal area. A filament is formed by a polymer exiting the end of the capillary in three separate strands having the shape of the openings, and each strand bulges radially outwardly such that the strands merge together.

17 Claims, 5 Drawing Sheets

(56) References Cited

U.S. PATENT DOCUMENTS

| | | | |
|---|---|---|---|
| 3,772,137 | A | 11/1973 | Tolliver |
| 4,110,965 | A | 9/1978 | Bradley et al. |
| 4,279,053 | A | 7/1981 | Payne et al. |
| 4,383,817 | A | 5/1983 | Mirhej et al. |
| 4,398,933 | A | 8/1983 | Lecron et al. |
| 4,648,830 | A | 3/1987 | Peterson et al. |
| 4,770,938 | A | 9/1988 | Morrison et al. |
| 5,108,838 | A | 4/1992 | Tung et al. |
| 5,125,818 | A | 6/1992 | Yeh et al. |
| 5,154,908 | A | 10/1992 | Edie et al. |
| 5,190,821 | A | 3/1993 | Jackson et al. |
| 5,208,106 | A | 5/1993 | Tung et al. |
| 5,208,107 | A | 5/1993 | Yeh et al. |
| 5,230,957 | A | 7/1993 | Lin et al. |
| 5,279,897 | A | 1/1994 | Jackson et al. |
| 5,322,736 | A | 6/1994 | Peterson et al. |
| 5,362,563 | A | 11/1994 | Lin et al. |
| 5,380,592 | A | 1/1995 | Tung et al. |
| 5,413,857 | A | 5/1995 | Li et al. |
| 5,462,802 | A | 10/1995 | Tajiri et al. |
| 5,486,417 | A | 1/1996 | Hagen et al. |
| 5,489,475 | A | 2/1996 | Hagen et al. |
| 5,512,367 | A | 4/1996 | Hagen et al. |
| 5,523,155 | A | 6/1996 | Lin et al. |
| 5,540,993 | A | 7/1996 | Hernandez et al. |
| 5,587,118 | A | 12/1996 | Mallonee et al. |
| 5,597,650 | A | 1/1997 | Mallonee et al. |
| 5,620,797 | A | 4/1997 | Mallonee et al. |
| 5,686,121 | A | 11/1997 | Samuelson et al. |
| D410,554 | S | 6/1999 | Guyton |
| 5,922,462 | A | 7/1999 | Kent et al. |
| 5,932,346 | A | 8/1999 | Kent et al. |
| 5,948,528 | A | 9/1999 | Helms, Jr. et al. |
| 5,985,193 | A | 11/1999 | Newport et al. |
| 6,017,478 | A | 1/2000 | Kent et al. |
| D422,099 | S | 3/2000 | Kracke |
| 6,048,615 | A | 4/2000 | Lin et al. |
| 6,153,138 | A | 11/2000 | Helms, Jr. et al. |
| 6,162,382 | A | 12/2000 | Kent et al. |
| 6,395,392 | B1 | 5/2002 | Gownder et al. |
| 6,458,726 | B1 | 10/2002 | Harrington et al. |
| 6,589,653 | B2 | 7/2003 | Lin |
| 6,620,505 | B1 | 9/2003 | Koyanagi et al. |
| 6,652,965 | B2 | 11/2003 | Merigold et al. |
| 6,660,377 | B2 | 12/2003 | Bernaschek |
| 6,673,442 | B2 | 1/2004 | Johnson et al. |
| 6,673,450 | B2 | 1/2004 | Portus et al. |
| 6,740,401 | B1 | 5/2004 | Nishimura et al. |
| 6,803,102 | B1 | 10/2004 | Haggard et al. |
| 6,939,608 | B2 | 9/2005 | Tung |
| 6,958,188 | B2 | 10/2005 | Moorhead et al. |
| 7,028,695 | B2 | 4/2006 | Montoli et al. |
| 7,087,303 | B2 | 8/2006 | Tung |
| D549,360 | S | 8/2007 | An |
| D550,864 | S | 9/2007 | Emerling et al. |
| 7,883,772 | B2 | 2/2011 | Sharp et al. |
| 7,968,480 | B2 | 6/2011 | Delattre et al. |
| 7,981,226 | B2 | 7/2011 | Sharp et al. |
| 7,998,577 | B2 | 8/2011 | Yost et al. |
| 8,043,689 | B2 | 10/2011 | Weiser et al. |
| 8,137,811 | B2 | 3/2012 | Dugan et al. |
| 8,297,035 | B2 | 10/2012 | Tachibana et al. |
| 8,420,556 | B2 | 4/2013 | Sharp et al. |
| D689,215 | S | 9/2013 | Xue |
| 11,608,571 | B2 * | 3/2023 | Meinders ..... D01D 5/253 |
| 2003/0096114 | A1 | 5/2003 | Chen et al. |
| 2003/0119403 | A1 | 6/2003 | Willis et al. |
| 2004/0147194 | A1 | 7/2004 | Willis et al. |
| 2004/0170836 | A1 | 9/2004 | Bond et al. |
| 2005/0112373 | A1 | 5/2005 | Tung |
| 2006/0008548 | A1 * | 1/2006 | Tung ..... D01D 5/253 425/72.2 |
| 2007/0077427 | A1 | 4/2007 | Dugan et al. |
| 2007/0128404 | A1 | 6/2007 | Tung et al. |
| 2007/0207317 | A1 | 9/2007 | Willingham et al. |
| 2008/0032579 | A1 | 2/2008 | Abed et al. |
| 2010/0029161 | A1 | 2/2010 | Pourdeyhimi |
| 2010/0159186 | A1 | 6/2010 | Samuelson et al. |
| 2011/0281057 | A1 | 11/2011 | Tung et al. |
| 2011/0287210 | A1 | 11/2011 | Tung et al. |
| 2012/0128437 | A1 | 5/2012 | Weiser et al. |
| 2012/0231207 | A1 | 9/2012 | Rock et al. |
| 2012/0231690 | A1 | 9/2012 | Pourdeyhimi et al. |
| 2012/0238982 | A1 | 9/2012 | Weisman |
| 2012/0289107 | A1 | 11/2012 | Beissinger et al. |
| 2013/0029086 | A1 | 1/2013 | Samuelson et al. |
| 2013/0029152 | A1 | 1/2013 | Samuelson et al. |
| 2013/0059495 | A1 | 3/2013 | Dempster et al. |
| 2013/0344331 | A1 | 12/2013 | Corn et al. |
| 2014/0103556 | A1 | 4/2014 | Diaz de Leon Izquierdo et al. |
| 2015/0275400 | A1 | 10/2015 | Tung et al. |

OTHER PUBLICATIONS

Final Office Action issued in U.S. Appl. No. 15/488,825, mailed Jun. 26, 2020.

Non-Final Office Action in connection to U.S. Appl. No. 15/488,825, mailed Mar. 29, 2022.

Interview Summary in connection to U.S. Appl. No. 15/488,825, mailed Mar. 10, 2022.

Non-Final Office Action issued in U.S. Appl. No. 15/488,825, mailed Feb. 21, 2020.

Non-Final Office Action issued in U.S. Appl. No. 15/488,825, mailed Dec. 23, 2020.

Final Office Action in U.S. Appl. No. 15/488,825, dated Aug. 16, 2021 (10 pages).

Office Action in U.S. Appl. No. 15/488,825, dated Feb. 8, 2019 (9 pages).

Office Action in U.S. Appl. No. 15/488,825, dated Aug. 22, 2019 (11 pages).

Non-final Office Action issued in U.S. Design U.S. Appl. No. 29/583,406, mailed Mar. 26, 2018.

BASF. "Ultramid® Grades in Extrusion." Aug. 2004. Available as: http://www.polyrob.net/files/adminpolyrob/fichaTecnica/basf/ultramidNylon6/Ultramidbrochure.pdf (Year: 2004).

* cited by examiner

TRILOBAL FILAMENTS AND SPINNERETS FOR PRODUCING THE SAME

CROSS REFERENCE TO RELATED APPLICATIONS

This application is a continuation of U.S. application Ser. No. 16/430,411, filed Jun. 3, 2019, entitled "Trilobal Filaments and Spinnerets for Producing the Same," which is a divisional of U.S. application Ser. No. 15/488,825, filed Apr. 17, 2017, entitled "Trilobal Filaments and Spinnerets for Producing the Same," which claims priority to U.S. Provisional Patent Application No. 62/376,698, filed Aug. 18, 2016, entitled "Trilobal Filaments and Spinnerets for Producing the Same," which are herein incorporated by reference in their entireties.

BACKGROUND

FIG. 1 illustrates a prior art filament that has been used for soil hiding. The filament shown in FIG. 1 includes four holes and is square shaped. The holes refract light passing through the filament, which helps to hide dirt, but the luster of the filament dulls over time and looks chalky when exposed to higher temperatures.

Thus, there is a need in the art for an improved filament that has soil hiding properties and is robust.

BRIEF SUMMARY

Various implementations include a filament formed from a thermoplastic polymer. The filament includes three lobes that extend from a central portion of the filament, and each lobe has a proximal end adjacent the central portion and a distal end radially spaced apart from the proximal end. The edges of each lobe between the proximal end and the distal end thereof define a continuous concave curve relative to an axis extending through the distal end of the respective lobe and the central portion of the filament. A width of each lobe is greatest at the proximal end thereof. Adjacent edges of adjacent lobes intersect each other at concave proximal ends of the adjacent edges, and the central portion defines an axial void.

In certain implementations, the void can be round or triangular. For example, in some implementations having a triangular shaped void, the void has concave shaped sides relative to a central axis extending axially through the void. In addition, in some implementations having a triangular shaped void, the vertices of the void extend toward the intersections of the adjacent edges of adjacent lobes.

In some implementations, lines tangential to adjacent edges of adjacent lobes at the proximal ends of the adjacent edges intersect at an angle of between 120° and 180°.

In some implementations, a line tangential to the tip of each lobe adjacent the distal end of the respective lobe and a line perpendicular to the axis extending through the distal end of the respective lobe and the central portion of the filament intersect at an angle of between 0° and 45°.

In some implementations, the filament has a first radius R1 that extends from a central axis of the filament to a geometric center of the distal end of one of the lobes and a second radius R2 that extends from the central axis of the filament to the intersection of adjacent edges of two adjacent lobes, and a ratio of the first radius R1 to the second radius R2 defines an external modification ratio (R1/R2) of between 2.0 and 2.5. In certain implementations, each distal end of each lobe has a tip radius R3, and a ratio of the first radius R1 to the tip radius R3 defines a first tip ratio (R1/R3) of between 0.17 and 0.27. And, in some implementations, a ratio of the second radius R2 to the tip radius R3 defines a second tip ratio (R2/R3) of between 0.4 and 0.6.

In some implementations, an area of the void is 2% to 3.5% of a cross-sectional area of the filament.

In some implementations, a modification ratio of the void is between 1.0 and 2.0.

In some implementations, the filament is 24 denier per filament.

In some implementations, the thermoplastic polymer comprises Nylon 6.

In some implementations, the relative viscosity of Nylon 6 is between 2.4 and 3.6.

Other implementations include a spinneret plate for producing filament. The spinneret plate includes one or more capillaries, and each capillary includes a substantially hexagonal shaped central area, an outer radial area that is radially spaced apart from the substantially hexagonal shaped central area, and legs that extend between the outer radial area and the substantially hexagonal shaped central area. The capillary defines three openings, and each opening is defined between the substantially hexagonal shaped central area, the outer radial area, and two adjacent legs. Each opening has a proximal end adjacent the substantially hexagonal shaped central area and a distal end adjacent the outer radial area, and the proximal end has a greater width than the distal end such that each opening has a substantially triangular shape.

In some implementations, the proximal end of each opening has a geometric center defined by an intersection of two adjacent sides of the substantially hexagonal shaped central area adjacent the opening.

In some implementations, the distal end of each opening has a rounded tip.

BRIEF DESCRIPTION OF THE DRAWINGS

Various implementations are explained in even greater detail in the following exemplary drawings. The drawings are merely exemplary to illustrate the structure of various devices and certain features that may be used singularly or in combination with other features. The invention should not be limited to the implementations shown.

DETAILED DESCRIPTION

Various implementations include a thermoplastic polymer filament that provides improved soil hiding without dulling the luster of the filament. In addition, the filament maintains its color over a wide temperature range and is durable. Such a filament may be useful in carpets or textiles, for example. In addition, various implementations include a spinneret plate that defines one or more capillaries for producing the filament.

Figure 2:
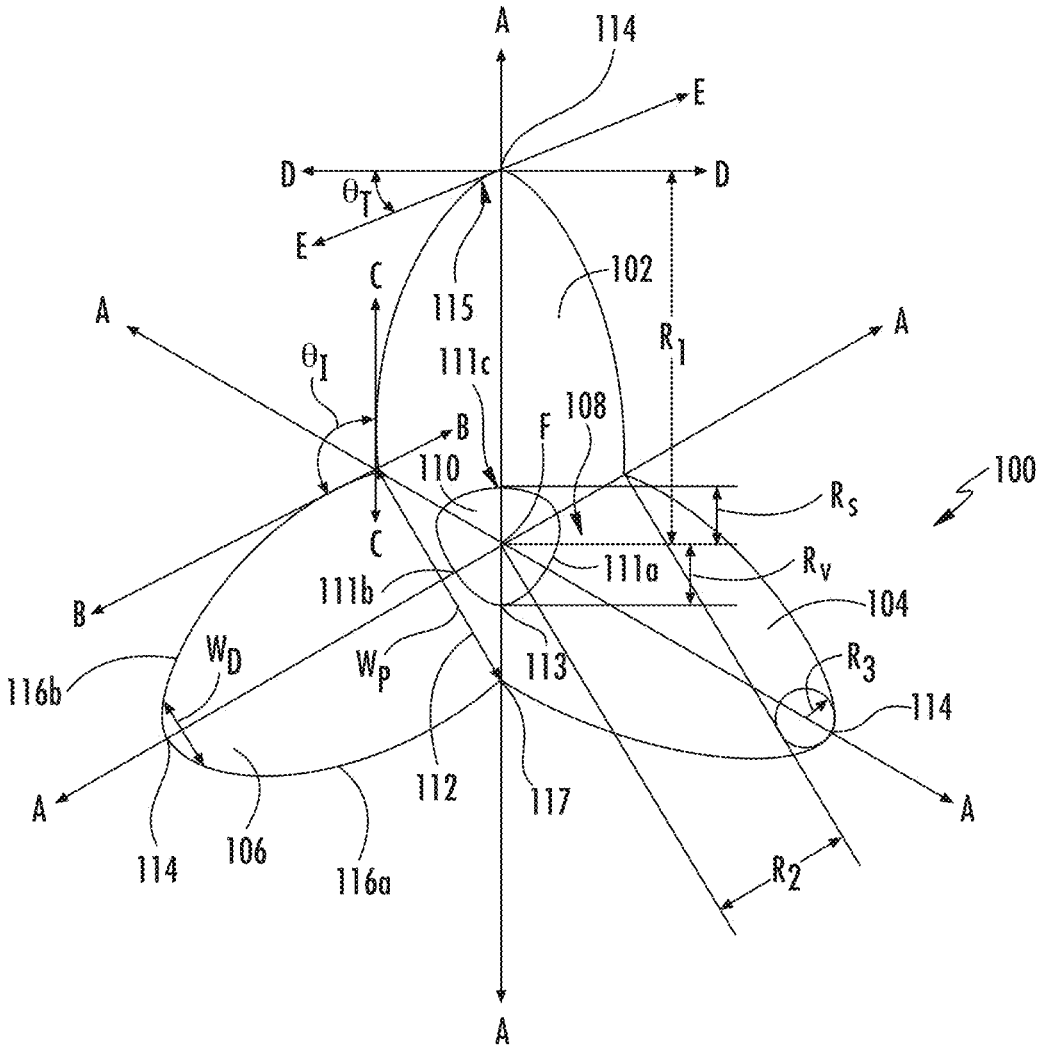
FIG. 2 illustrates an end view of a filament according to one implementation.

For example, FIG. 2 illustrates one implementation of a filament 100. The filament 100 includes three lobes 102, 104, 106 that extend from a central portion 108 of the filament 100, and the central portion 108 defines an axial void 110. Each lobe 102, 104, 106 bulges outwardly at its proximal end 112 adjacent the central portion 108 and has edges 116*a*, 116*b* that form a continuous concave curve toward its distal end 114 relative to an axis A-A that extends through the distal end 114 of the respective lobe 102, 104, 106 and the central portion 108 of the filament 100. Thus, a width Wp of each lobe 102, 104, 106 at the proximal end 112 thereof is greater than a Wp at or adjacent the distal end 114, and adjacent edges 116*a*, 116*b* of adjacent lobes intersect each other at concave proximal ends 117 of the adjacent edges 116*a*, 116*b*.

In addition, line B-B is tangential to edge 116*b* of lobe 106 at the proximal end 117 of the edge 116*b*, and line C-C is tangential to edge 116*a* of lobe 102 at the proximal end 117 of the edge 116*a*. Edge 116*b* of lobe 106 is adjacent edge 116*a* of lobe 102, and lines B-B and C-C intersect at an angle $\Theta_I$ of 120°. However, in other implementations, $\Theta_I$ is between 120° and 180°.

In addition, line D-D is perpendicular to the axis A-A that extends through the distal end 114 of lobe 102 and the central portion 108, and line E-E is tangential to a portion 115 of a tip portion of the lobe 102 adjacent the distal end 114 of lobe 102. Lines D-D and E-E intersect at an angle $\Theta_T$ of 30°. However, in other implementations, $\Theta_T$ is between 0° and 45°.

Furthermore, in the implementation shown in FIG. 2, the distal end 114 of each lobe is aligned with the intersection 117 of the other two lobes. In particular, line A-A extending through the distal end 114 of lobe 102 and central portion 108 extends through the intersection 117 of the adjacent edges 116*a*, 116*b* of adjacent lobes 104 and 106. Similarly, line A-A extending through the distal end 114 of lobe 104 and central portion 108 extends through the intersection 117 of adjacent edges 116*a*, 116*b* of adjacent lobes 102 and 106. And, line A-A extending through the distal end 114 of lobe 106 and central portion 108 extends through the intersection 117 of adjacent edges 116*a*, 116*b* of adjacent lobes 102 and 104. However, in other implementations, the lobes may not be equispaced about the central portion.

The filament 100 also has a radius R1 that extends from the central axis F of the filament 100 to the distal end 114 of any one of the lobes 102, 104, 106 and a second radius R2 that extends from the central axis F to the intersection of adjacent edges 116*a*, 116*b* of any two adjacent lobes 102, 104, 106. A ratio of the radius R1 to the radius R2 defines an external modification ratio (R1/R2) of between 2.0 and 2.5. For example, in one implementation, the external modification ratio is 2.2. In addition, each distal end 114 has a tip radius R3, and a ratio of the radius R1 to the tip radius R3 defines a first tip ratio (R1/R3) of between 0.17 and 0.27 (e.g., 0.21). A ratio of the radius R2 to the tip radius R3 defines a second tip ratio (R2/R3) of between 0.4 and 0.6 (e.g., 0.55).

In other implementations, the tip portion adjacent the distal end 114 of each lobe is non-circular shaped.

Figure 1:
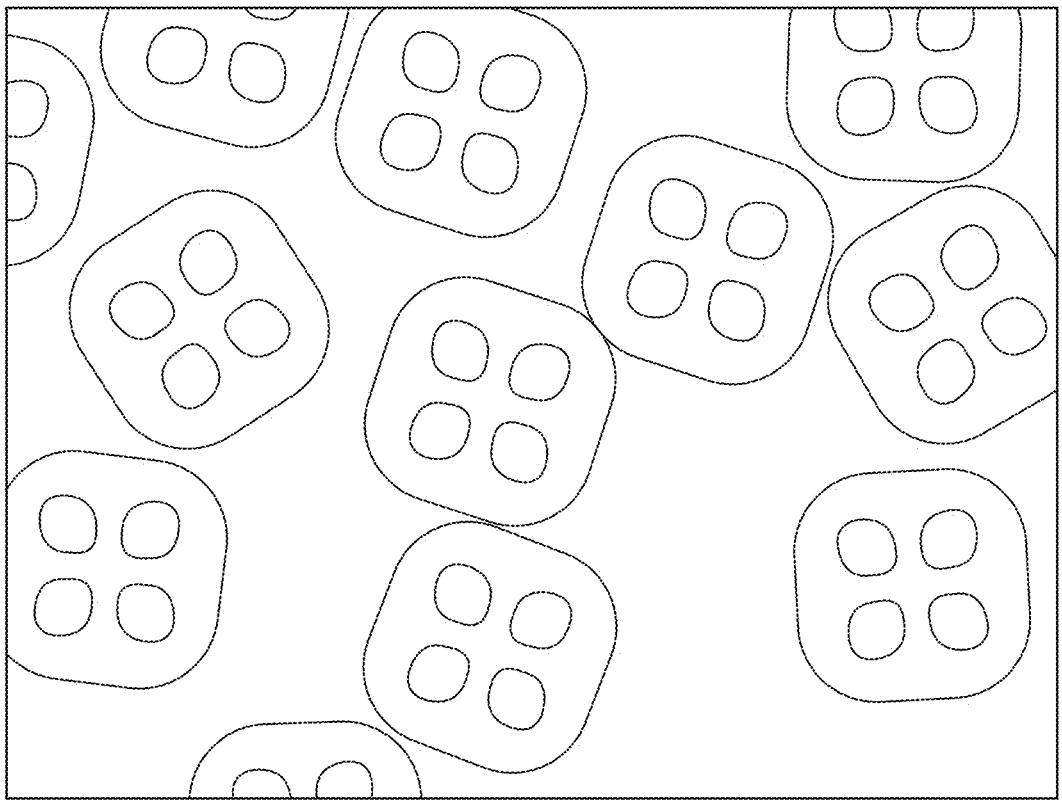
FIG. 1 PRIOR ART
FIG. 1 illustrates an end view of a filament in the prior art.

The void 110 shown in FIG. 1 has three concave shaped sides 111*a*, 111*b*, 111*c* relative to the central axis F that extends axially through the void 110. The sides 111*a-c* define an acorn or bulging triangular shape. In addition, vertices 113 of the void 110 are defined by each pair of intersecting sides 111*a*-111*c*, and each vertex 113 is aligned with the intersection 117 of the adjacent edges 116*a*, 116*b* of adjacent lobes 102, 104, 106 that is nearest the respective vertex 113 and the central axis F. In other implementations, the void 110 is round or triangular.

According to some implementations, an area of the void 110 is 2% to 3.5% of a cross sectional area of the filament 100. And, a modification ratio of the radius Ry from the central axis F to one of the vertices 113 to the radius $R_S$ from the central axis F to a midpoint of one of the sides 111*a-c* ($R_V/R_S$) is between 1.0 and 2.0 (e.g., 1.5 to 2.0).

According to some implementations, the void 110 causes light to scatter when passing through the filament 100, which helps with hiding soil. In addition, the low external modification ratio of R1/R2 provides less surface area to which soil can cling and is durable.

Figure 3:
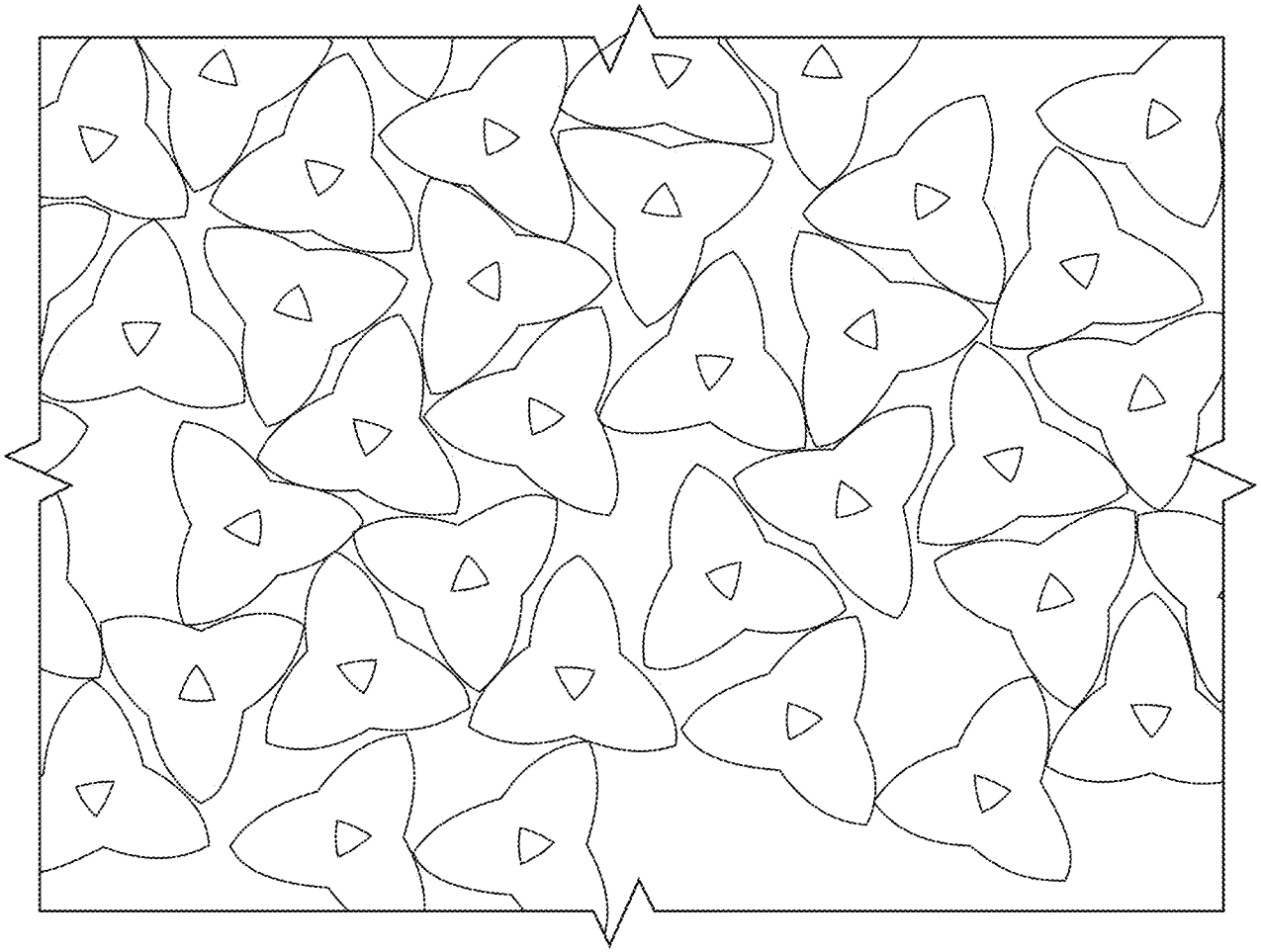
FIG. 3 illustrates an end view of a plurality of filaments, such as the filament shown in FIG. 2.

The thermoplastic polymer used to produce the filament 100 in FIGS. 2 and 3 includes Nylon 6, but other suitable thermoplastic polymers may be used in other implementations. For example, other exemplary polymers include Nylon 6,6, polyethylene terephthalate (PET), and polytrimethylene terephthalate (PTT). The relative viscosity of the nylon 6 is between 2.4 and 3.6. The filament 100 is at least 24 denier, but other implementations may have various other suitable deniers.

Figure 4:
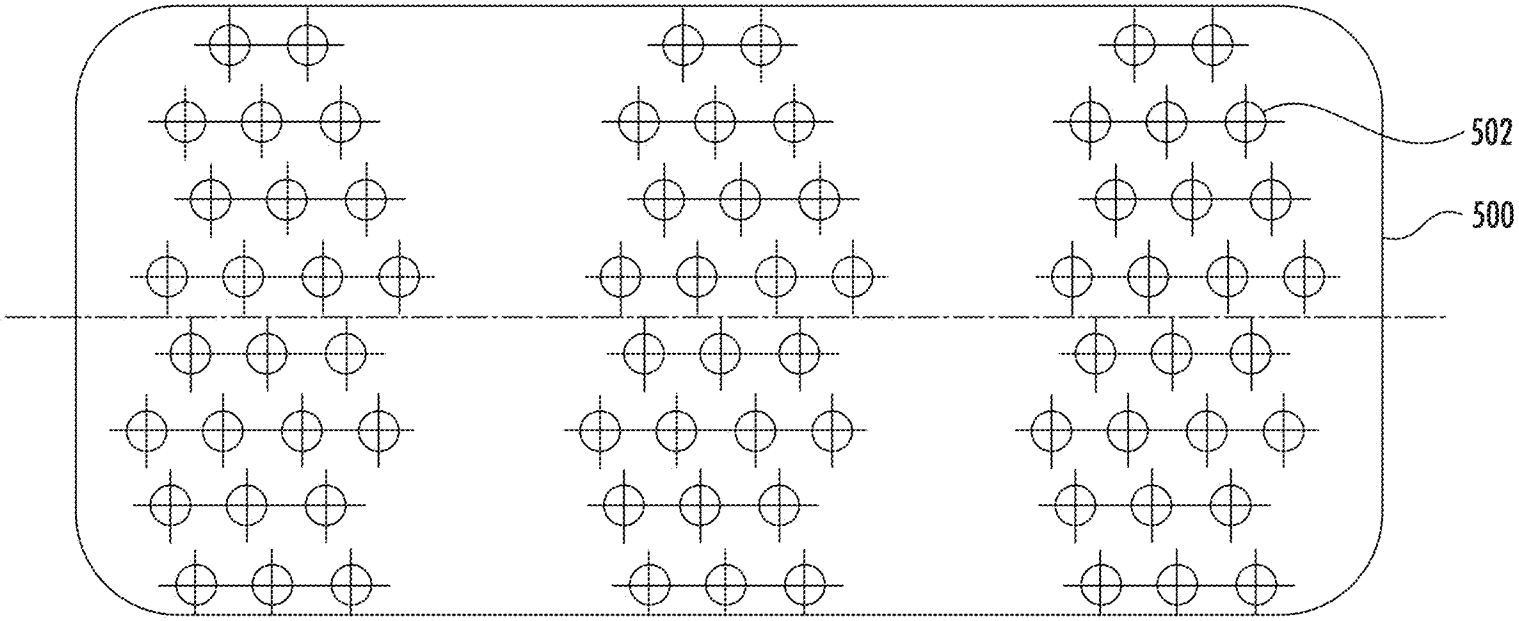
FIG. 4 illustrates a spinneret plate having a plurality of capillaries according to one implementation.
Figure 5:
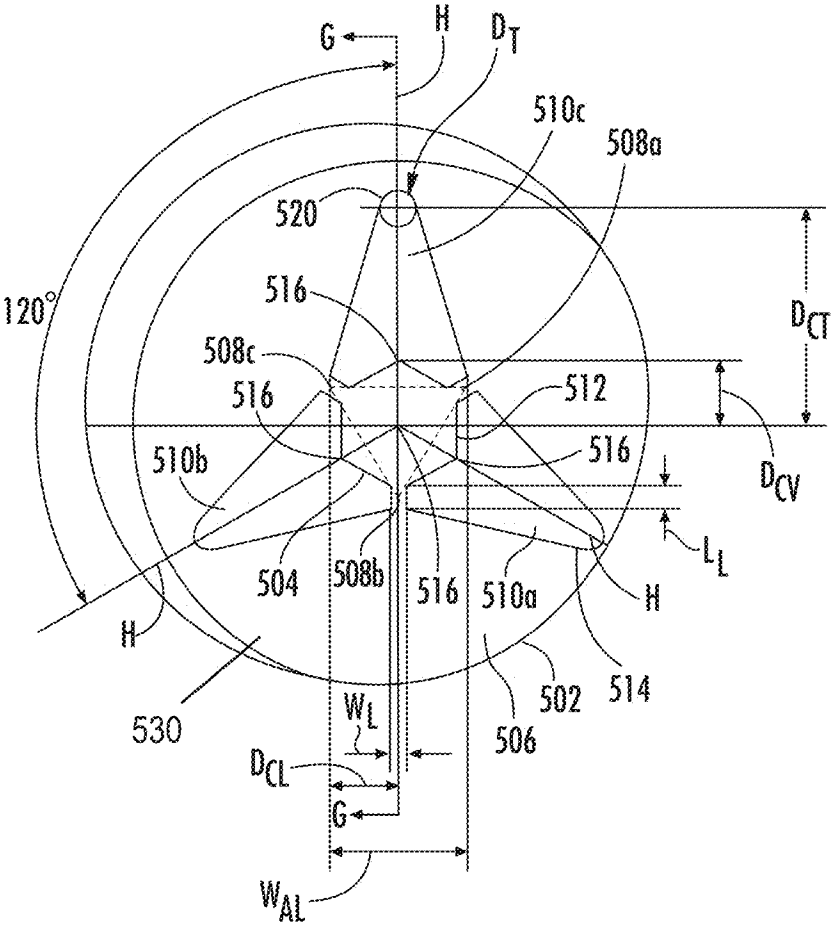
FIG. 5 illustrates an end view of one of the capillaries of the spinneret plate of FIG. 4.

Various implementations also include a spinneret plate for producing filament. FIG. 4 illustrates a spinneret plate 500 that includes a plurality of capillaries 502. FIG. 5 illustrates an end view of one capillary 502 including an extrusion surface 530. As shown in FIG. 5, the capillary 502 includes a hexagonally shaped central area 504, an outer radial area 506 that is radially spaced apart from the hexagonally shaped central area 504, and legs 508*a*, 508*b*, 508*c* that extend between the outer radial area 506 and the hexagonally shaped central area 504. The capillary 502 defines three openings 510*a*, 510*b*, 510*c*, and each opening 510*a*, 510*b*, 510*c* is defined between the substantially hexagonal shaped central area 504, the outer radial area 506, and two adjacent legs 508*a*, 508*b*, 508*c*. Each opening 510*a*, 510*b*, 510*c* has a proximal end 512 adjacent the substantially hexagonal shaped central area 504 and a distal end 514 adjacent the outer radial area 506. The proximal end 512 has a greater width than the distal end 514 such that each opening 510*a*, 510*b*, 510*c* has a substantially triangular shape.

In addition, the proximal end 512 of each opening 510*a*, 510*b*, 510*c* has a geometric center 516 defined by an intersection of two adjacent sides of the substantially hexagonal shaped central area 504 adjacent the respective opening 510*a*, 510*b*, 510*c*.

The distal end 514 of each opening 510*a*, 510*b*, 510*c* has a rounded tip. For example, the rounded tip of each opening 510*a-c* may have a diameter $D_T$ of 0.16 mm. However, in other implementations, the tip may have a different diameter or be more pointed.

In the implementation shown in FIG. 5, the width $W_L$ of each leg 508*a*, 508*b*, 508*c* is 0.076 mm, the length $L_L$ of each leg 508*a*, 508*b*, 508*c* is 0.11 mm, the width $W_{AL}$ between outer ends of adjacent legs 508*a*, 508*b*, 508*c* is 0.67 mm, the distance $D_{CL}$ between the center 516 of the hexagonal area 504 and one of the vertices 518 of the hexagonal area 504 is 0.31 mm, the distance $D_{CL}$ between the center 516 and an outer end of one of the legs 508*a*, 508*b*, 508*c* is 0.34 mm, and the distance $D_{CT}$ between the center 516 and a proximal end 520 of a tip of one of the openings 510*a*, 510*b*, 510*c* is 1.05 mm. In addition, lines H-H extending through the distal end 514 of each opening 510*a*, 510*b*, 510*c* and the center 516 are 120° apart.

Figure 6:
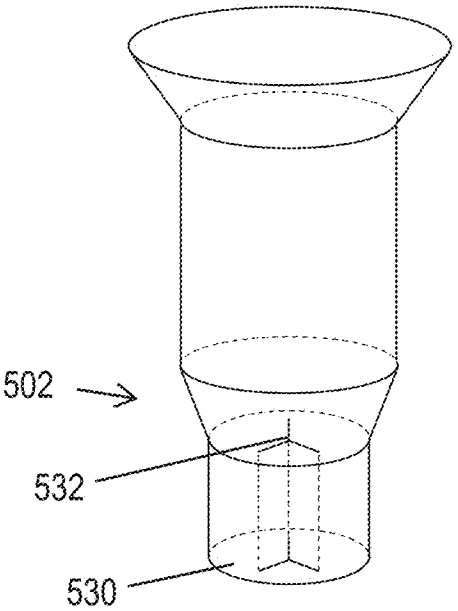
FIG. 6 illustrates a schematic view of the capillary in FIG. 5.

FIG. 6 illustrates a schematic view of the capillary 502 shown in FIGS. 4 and 5. The capillary 502 is 6 mm deep, but in other implementations, this depth may be changed depending on the drawing speed and polymer being used. As shown in FIG. 6, the capillary 502, including each opening 510*a*, 510*b*, and 510*c*, extends vertically from the extrusion surface 530 and meets at a junction 532 spaced apart from the extrusion surface 530.

The polymer exiting the end of the capillary 502 exits in three separate strands having the shape of the openings 510*a*, 510*b*, 510*c*, and each strand bulges radially outwardly such that the strands merge together, forming the intersection 117 of adjacent lobes 102, 104, 106 and the central portion 108 and void 110 of the filament 100 shown in FIG. 2.

In addition, the filament 100 may be a continuously drawn filament or may be a crimp and cut filament (e.g., to form staple fibers).

The terminology used herein is for the purpose of describing particular implementations only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

While the foregoing description and drawings represent the preferred implementation of the present invention, it will be understood that various additions, modifications, combinations and/or substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. In addition, features described herein may be used singularly or in combination with other features. The presently disclosed

The invention claimed is:

1. A spinneret plate defining a plurality of capillaries, each capillary comprising:

a first capillary portion, a second capillary portion, a third capillary portion, and a substantially hexagonal central area, wherein the first capillary portion comprises a substantially triangular extrusion area and a first capillary portion major axis along a line from a center of the substantially hexagonal central area through a distal apex of the first capillary portion;

wherein:

the substantially hexagonal central area is joined to the spinneret plate by first and second legs, the legs being radially spaced apart and separated by a first apex of the substantially hexagonal central area;

each leg comprises a first edge and a second edge;

the first leg comprises a leg length extending between a first leg first point and a first leg second point wherein the first leg first point is located at an intersection of the spinneret plate and the first edge of the first leg, and the first leg second point is located at an intersection of the substantially hexagonal central area and the first edge of first leg;

the second leg comprises the leg length extending between a second leg first point and a second leg second point wherein the second leg first point is located at an intersection of the spinneret plate and the second edge of the second leg, and the second leg second point is located at an intersection of the substantially hexagonal central area and the second edge of second leg; and the first capillary portion is bounded by:

the first apex of the substantially hexagonal central area;

a first apex first side straight line from the first apex to the first leg second point;

a first leg first edge straight line from the first leg second point to the first leg first point;

a first substantially straight side edge extending from the first leg first point to the distal apex;

a second substantially straight side edge extending from the distal apex to the second leg first point;

a second leg second edge straight line from the second leg first point to the second leg second point; and a first apex second side straight line from the second leg second point to the first apex.

2. The spinneret plate of claim 1, wherein the distal apex is rounded.

3. The spinneret plate of claim 2, wherein the rounded distal apex has a diameter of 0.16 mm.

4. The spinneret plate of claim 3, wherein; the spinneret plate comprises a top first surface and an extrusion surface, such that the top surface is parallel to, opposite from, and distal from the extrusion surface; and wherein the first, second, and third capillary portions extend orthogonally from the extrusion surface towards the top surface.

5. The spinneret plate of claim 4, wherein the first, second, and third capillary portions are fluidly connected at a junction between the top surface and the extrusion surface within the spinneret plate.

6. The spinneret plate of claim 5, wherein the substantially hexagonal central area extends from the extrusion surface to the junction.

7. The spinneret plate of claim 5, wherein the first and second legs are joined to the substantially hexagonal central area along lengths extending from the extrusion surface to the junction.

8. The spinneret plate of claim 2, wherein:

the second capillary portion has an identical extrusion area as the first capillary portion, and the second capillary portion comprises a second capillary portion major axis along a line from the center of the substantially hexagonal central area through a distal apex of the second capillary portion;

the substantially hexagonal central area is joined to the spinneret plate a third leg, the third leg being radially spaced apart from the first leg and the second leg and separated from the second leg by a second apex of the substantially hexagonal central area;

the third leg comprises a first and a second edge;

the second leg comprises the leg length extending between a second leg third point and a second leg fourth point wherein the second leg third point is located at an intersection of the spinneret plate and the first edge of the second leg, and the second leg fourth point is located at an intersection of the substantially hexagonal central area and the first edge of second leg the third leg comprises the leg length extending between a third leg first point and a third leg second point wherein the third leg first point is located at an intersection of the spinneret plate and the second edge of the third leg, and the third leg second point is located at an intersection of the substantially hexagonal central area and the second edge of third leg; and the second capillary portion is bounded by:

the second apex of the substantially hexagonal central area;

a second apex first side straight line from the second apex to the second leg fourth point;

a second leg first edge straight line from the second leg fourth point to the second leg third point;

a first substantially straight side edge extending from the second leg third point to the distal apex of the second capillary portion;

a second substantially straight side edge extending from the distal apex of the second capillary portion to the third leg first point;

a third leg first edge straight line from the third leg first point to the third leg second point; and a second apex second side straight line from the third leg second point to the second apex.

9. The spinneret plate of claim 8, wherein the first capillary portion major axis and the second capillary portion major axis are 120° apart.

10. The spinneret plate of claim 2, wherein the rounded distal apex has a diameter of 0.16 mm, and wherein the first substantially straight side edge and the second substantially straight side edge meet the rounded distal apex at a tangent.

11. The spinneret plate of claim 10, wherein a distance between the center of the substantially hexagonal area and a center of the diameter of the rounded distal apex is 1.05 millimeters.

12. The spinneret plate of claim 1, wherein the leg length is 0.11 millimeters.

13. The spinneret plate of claim 1, wherein the first leg has a leg width of 0.67 millimeters.

14. The spinneret plate of claim 1, wherein a distance between the center of the substantially hexagonal area and the first apex is 0.31 millimeters.

15. The spinneret plate of claim 1, wherein a distance between the center of the substantially hexagonal area and a center of a line drawn between the first point of the second edge of the second leg and the third point of the first edge of the second leg is 0.34 millimeters.

16. The spinneret plate of claim 6, wherein a distance from the extrusion surface to the junction is 6 millimeters.

17. The spinneret plate of claim 6, wherein a distance from the extrusion surface to the junction is configured from a drawing speed of a polymer configured to be extruded through the substantially triangular extrusion area.

* * * * *